US007621210B2

(12) United States Patent
Fluhr et al.

(10) Patent No.: US 7,621,210 B2
(45) Date of Patent: Nov. 24, 2009

(54) GAS BLEED ASSEMBLIES FOR USE WITH FIREARMS

(75) Inventors: Norbet Fluhr, Oberndorf (DE); Berthold Weichert, Zimmern (DE); Stefan Doll, Oberndorf (DE); Ernst Wossner, Sulz (DE); Martin Stussak, Schomberg (DE)

(73) Assignee: Heckler & Koch, GmbH, Oberndorf/Neckar (DE)

( * ) Notice: Subject to any disclaimer, the term of this patent is extended or adjusted under 35 U.S.C. 154(b) by 0 days.

(21) Appl. No.: 12/143,515

(22) Filed: Jun. 20, 2008

(65) Prior Publication Data

US 2008/0307954 A1 Dec. 18, 2008

Related U.S. Application Data

(63) Continuation-in-part of application No. PCT/EP2006/011947, filed on Dec. 12, 2006.

(30) Foreign Application Priority Data

Dec. 23, 2005 (DE) ..... 10 2005 062 758

(51) Int. Cl.
*F41A 5/28* (2006.01)

(52) U.S. Cl. ..... 89/193

(58) Field of Classification Search ..... 89/191.01, 89/191.02, 192, 193
See application file for complete search history.

(56) References Cited

U.S. PATENT DOCUMENTS 454,403 A * 6/1891 Odkolek ..... 89/152
729,413 A * 5/1903 Reifgraber ..... 89/154
1,738,501 A * 12/1929 Moore ..... 89/193
1,808,052 A 6/1931 McCann
2,003,066 A * 5/1935 Brondby ..... 89/193

(Continued)

FOREIGN PATENT DOCUMENTS

DE 648391 7/1937

(Continued)

OTHER PUBLICATIONS

Patent Cooperation Treaty, "International Search Report", issued in connection with counterpart PCT application Serial No. PCT/EP2006/011947 by the International Searching Authority, mailed Mar. 2, 2007 (6 pages).

(Continued)

*Primary Examiner*—Bret Hayes
(74) *Attorney, Agent, or Firm*—Hanley, Flight and Zimmerman, LLC

(57) ABSTRACT

Gas bleed assemblies for use with firearms are described. An example gas bleed assembly for use with a firearm having a barrel includes a gas cylinder that defines at least one gas outlet to be fluidly coupled to a bore of a barrel. The gas cylinder is substantially fixed relative to the barrel. Additionally the example gas bleed assembly includes a holding fixture that is substantially fixed relative to a housing having a front edge. The holding fixture interacts with the at least one gas outlet. A temperature induced variation of geometry of the barrel changes a position of the gas cylinder relative to the holding fixture and wherein a pressure acting within the gas cylinder is associated with the position of the at least one gas outlet relative to the holding fixture.

21 Claims, 5 Drawing Sheets

U.S. PATENT DOCUMENTS

| | | | | | |
|---|---|---|---|---|---|
| 2,685,754 | A | * | 8/1954 | Crittendon et al. | 42/16 |
| 2,918,848 | A | | 12/1959 | Maillard | |
| 3,680,434 | A | * | 8/1972 | Muhlemann | 89/193 |
| 3,690,219 | A | | 9/1972 | Muhlemann et al. | |
| 3,795,173 | A | * | 3/1974 | Freymond | 89/193 |
| 3,982,468 | A | * | 9/1976 | Browning | 89/193 |
| 4,279,191 | A | * | 7/1981 | Johansson | 89/185 |
| 4,611,525 | A | | 9/1986 | Bosshard et al. | |
| 5,429,034 | A | | 7/1995 | Badali et al. | |
| 5,824,943 | A | | 10/1998 | Guhring et al. | |
| 6,516,700 | B1 | * | 2/2003 | Nikonov et al. | 89/191.01 |

FOREIGN PATENT DOCUMENTS

| | | |
|---|---|---|
| DE | 19615181 | 10/1997 |
| DE | 69412384 T | 3/1999 |
| EP | 0167067 | 1/1986 |
| GB | 1308375 | 2/1973 |

OTHER PUBLICATIONS

Patent Cooperation Treaty, "Written Opinion of the International Preliminary Examining Authority", issued in connection with PCT application serial No. PCT/EP2006/011947 by the International Searching Authority, mailed Mar. 2, 2007 (5 pages, with 4 page translation).

International Bureau, "International Preliminary Report on Patentability" issued in connection with counterpart PCT application Serial No. PCT/EP2006/011947, mailed Sep. 12, 2008 (6 pages).

* cited by examiner

GAS BLEED ASSEMBLIES FOR USE WITH FIREARMS

RELATED APPLICATION

This patent is a continuation-in-part of International Patent Application Serial No. PCT/EP2006/011947, filed Dec. 12, 2006, which claims priority to German Patent Application 10 2005 062 758.7, filed on Dec. 23, 2005, both of which are hereby incorporated herein by reference in their entireties.

FIELD OF THE DISCLOSURE

This disclosure relates generally to firearms and, more specifically, to gas bleed assemblies for use with firearms.

BACKGROUND

Typically, gas-operated rifles include a loading mechanism that is driven by ammunition gas pressure generated upon rifle firing and may include a gas piston arranged in a gas cylinder to assist in loading and unloading cartridges. The gas cylinder is at least partially sealed at an end so that a pressure chamber is formed between a gas piston face and a front wall of the gas cylinder. A passage fluidly couples the pressure chamber to the interior of the barrel. After a round is fired and the projectile (e.g., bullet) has passed a connecting point between the pressure chamber and the barrel bore, ammunition gases enter the pressure chamber. The ammunition gases increase a pressure within the pressure chamber and create a resulting force on a face of the piston. The resulting force on the piston acts against a linkage that is part of a loading mechanism and causes the cartridges to feed and eject due to the movement between the piston and the pressure chamber. Additionally, the resulting force on the piston activates (e.g., cocks) the trigger mechanism. The loading mechanism of fully automatic weapons operate as long as the trigger is held in the firing position. A portion of the energy created by firing a cartridge is diverted to operate the loading mechanism.

Typically, the cross-sections governing the flow of the ammunition gases, the piston, and the pressure chamber are designed to match the specifications of a particular firearm that fires at a determined frequency. Specifically, a firing cadence is selected to prevent mechanical overload of the drive mechanism. To maintain the firing cadence, the pressure chamber is provided with a gas outlet that is associated with a pressure setting and a pressure adaptation. Through the gas outlet, the ammunition gases that enter the pressure chamber exit into the environment to reduce the pressure within the pressure chamber. Specifically, the pressure chamber has a lower pressure as compared to the pressure within the barrel. For instance, DE 196 15 181 describes an ammunition gas bleed device.

DE 648 391 describes an adjustable valve that regulates the quantity of ammunition gas that enters the pressure chamber and, thus, the flow and pressure ratios in the ammunition gas bleed arrangement are adaptable to the particular firearm. In some instances, such as during longer sustained continuous fire of an automatic firearm (e.g., a machine gun), the flow and pressure ratios change because the barrel temperature significantly increases. Additionally, the temperature of the ammunition gas within the barrel increases along with the pressure within the barrel. As a result, the pressure within the pressure chamber acting on the gas piston increases, which, in turn, increases the force acting on the gas piston. This increase in pressure accelerates the loading process and increases the force acting on a throttle control rod and the entire loading mechanism.

Accelerating the loading process, increases the firing cadence as well as ammunition consumption. Additionally, the mechanical load on the firearm components increase the wear and tear on the weapon. Unnecessary consumption of ammunition may pose a logistical problem during a military action, because additional ammunition must be brought along and provided at the location that the firearm is being fired without the firearm performance being correspondingly improved.

Adjusting the flow and pressure ratios for stabilization of the cadence of known gas bleed devices is impractical and difficult under operating condition (e.g., firing the weapon). Known methods of maintaining firing cadence stability involves interchanging a second barrel with the hot barrel (e.g., the barrel that is being fired through).

DE 694 12 384 describes a gas feed mechanism for use with semi-automatic weapons and particularly, for use with semi-automatic shotguns. The gas feed mechanism requires a spring-loaded control valve to release gases from the barrel of the weapon to control the gas pressure and to limit the rate of motion of the movable parts.

DETAILED DESCRIPTION

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity. Additionally, several examples have been described throughout this specification. Any features from any example may be included with, a replacement for, or otherwise combined with other features from other examples. Further, throughout this description, position designations such as "above," "below," "top," "forward," "rear," "left," "right," etc. are referenced to a firearm held in a normal firing position (i.e., wherein the "shooting direction" is pointed away from the marksman in a generally horizontal direction) and from the point of view of the marksman. Furthermore, the normal firing position of the weapon is always assumed, i.e., the position in which the barrel runs along a horizontal axis.

The example methods and apparatus described herein can be used advantageously to substantially maintain a stable firing cadence during relatively long firing periods. In particular, the example methods and apparatus described herein involve substantially stabilizing and/or minimizing ammunition consumption and facilitating relatively low mechanical stress on weapon components. Additionally, the example methods and apparatus described herein increase the duration (i.e., the time period) between necessary barrel changes during relatively long firing periods. Additionally, the example methods and apparatus described herein may be used with a barrel or a tube of a gas-operated firearm (e.g., a semi-automatic weapon or an automatic weapon). Specifically, a first gas outlet that is defined by an example gas bleed assembly is fluidly coupled to a bore of a barrel.

Figure 1:
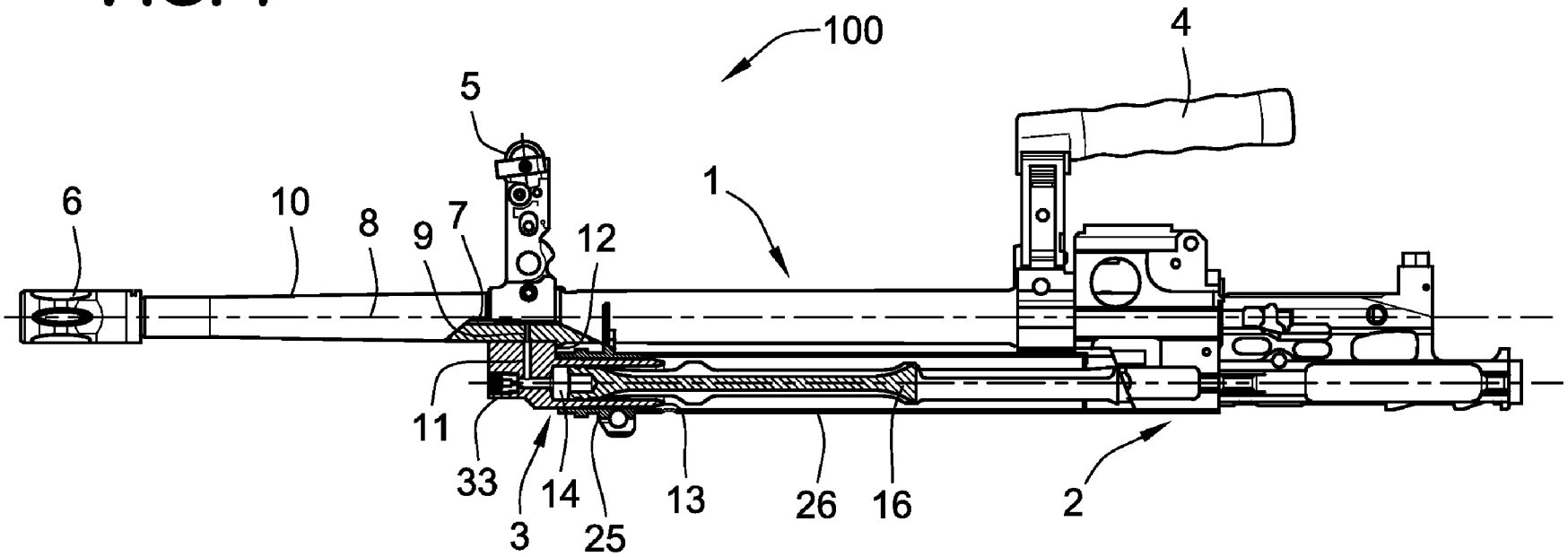
FIG. 1 depicts a portion of an example barrel, an example housing and an example gas bleed assembly.

FIG. 1 depicts a front portion of a firearm 100 (e.g., a machine gun) having a barrel assembly 1 and a housing assembly 2. A portion of the firearm 100 is a cross-sectional view. For clarity, the example illustration of FIG. 1 does not depict some housing components such as, for example, a trigger mechanism, a breech guide rail and a shoulder support.

The housing assembly 2 and the barrel assembly 1 are coupled together via a gas bleed assembly 3. A handle 4 is coupled to a top side of a barrel 10 and a flash suppressor 6 is coupled on an opposite end of the barrel 10. A sight 5 is coupled to the gas bleed assembly 3.

Ammunition (not shown) is automatically fed into the cartridge chamber (not shown) towards the rear of the barrel 10 where the ammunition is ignited (e.g., fired). Firing a round of ammunition, propels a bullet from a cartridge casing through a barrel bore 7 that is substantially concentric with an axis of a bore 8, towards the front of the barrel assembly 1 (e.g., a barrel muzzle). Once the bullet has traveled passed the gas bleed assembly 3, a portion of the ammunition gas enters the gas bleed assembly 3 via a tapping section 9, which, in the example of FIG. 1, is substantially perpendicular to the barrel bore 7. The portion of the ammunition gas flows from the tapping section 9 through a gas duct 11 to a main channel 12 into a pressure chamber 14 defined by a gas cylinder 13. The gas duct 11 is substantially coaxial with the tapping section 9, Turning now to FIG. 2, the illustration depicts an enlarged view of the barrel 10 and the gas bleed assembly 3. A piston 15 (e.g., a gas piston) is positioned within the gas cylinder 13 and is coupled to a throttle control rod 16. In this example implementation, the gas piston 15 is provided with a plurality of rings 17 that include cylindrical outer surfaces that guide and seal the gas piston 15 within the gas cylinder 13. Specifically, the plurality of rings 17 are sized to slidably and sealingly engage a cylindrical wall 18 of the gas cylinder 13. The cylindrical wall 18, the gas cylinder 13 and/or the plurality of rings 17 may be mechanically produced via, for example, lathing, milling, grinding, and/or honing, and may be treated using any suitable means such as, for example, the components may be hardened, chromed, and/or coated, to increase the durability of the contact surfaces.

After a round is fired, the ammunition gas flows to the pressure chamber 14 and increases the pressure within the pressure chamber 14. Specifically, the pressure increases between faces 19 and 50 of the gas piston 15 and faces 20 and 52 of the gas cylinder 13. Once the pressure within the pressure chamber 14 increases above a predetermined level, a force, created by the pressure (e.g., pressure impulses), moves the gas piston 15 to the rear of the firearm 100 (FIG. 1) along with the rod 16. As the rod 16 moves to the rear of the firearm 100 (FIG. 1), the rod 16 transfers the pressure impulse to a firearm drive (not shown) facilitating a breech block (not shown) and a loading mechanism (not shown) to, for example, cycle the firearm 100 (FIG. 1).

In this example implementation, the gas bleed assembly 3 and the gas cylinder 13 are constructed from a single piece of material and are coupled to the barrel 10 via a collar 21. The collar 21 is adjacent an outer jacket section 22. The barrel 10 defines a notch 23 that engages a surface of the collar 21. Additionally, the collar 21 and the gas bleed assembly 3 are axially coupled in a circumferential direction to the barrel 10 via a pinning 24 (e.g., a spring pinning). Further, the gas cylinder 13 is slidably coupled (e.g., axially slidably coupled) to a holding fixture 25 (e.g., a cylindrical holding fixture). The holding fixture 25 is coupled to the housing assembly 2 via a sleeve 26. Additionally, the holding fixture 25 is at least partially supported via a supporting element 27 that engages the barrel 10. The supporting element 27 enables some axial movement between the barrel 10 and the holding fixture 25. The supporting element 27 is positioned at roughly a right angle relative to the barrel 10. In other example implementations, the gas bleed assembly 3 and/or the collar 21 may be coupled to the barrel 10 by any other suitable means.

An inner surface 54 of the holding fixture 25 is provided with a sealing section 28 that engages a corresponding exterior surface 56 of the gas cylinder 13, and enables some axial sliding movement between the gas cylinder 13 and the holding fixture 25. A first gas outlet 29 is defined near the sealing section 28 through which a portion of the ammunition gas acting within the pressure chamber 14 exhausts into the atmosphere. In this example implementation, the first gas outlet 29 may be at least partially covered by the sealing section 28.

Figure 4:
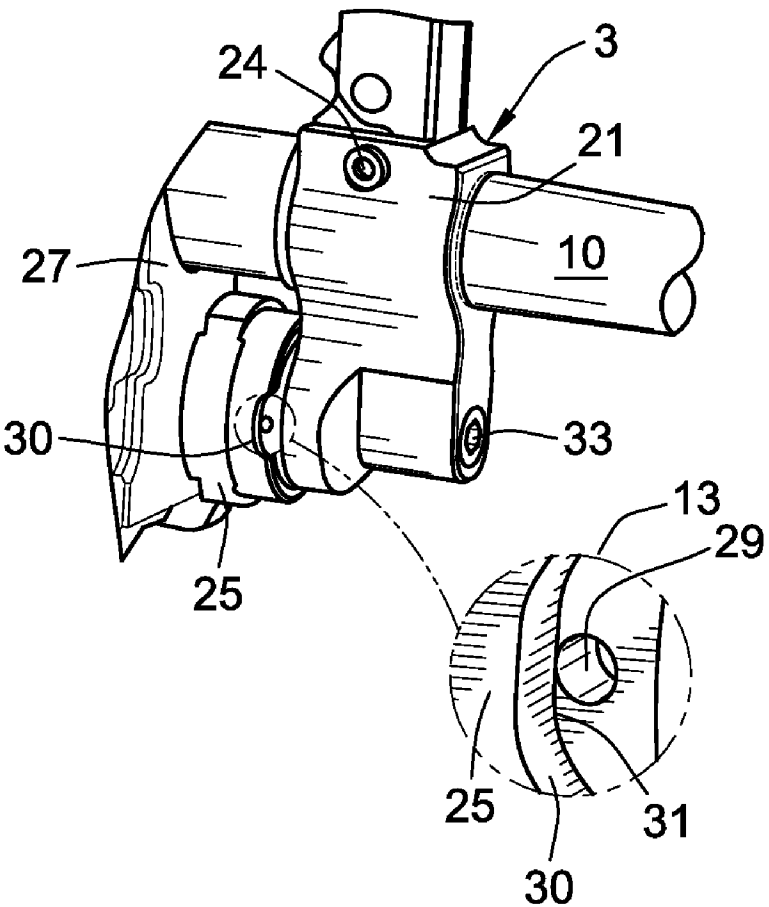
FIG. 4 depicts an enlarged view of the barrel and the example gas bleed assembly of FIG. 1 in a position representative of the barrel being relatively hot.
Figure 3:
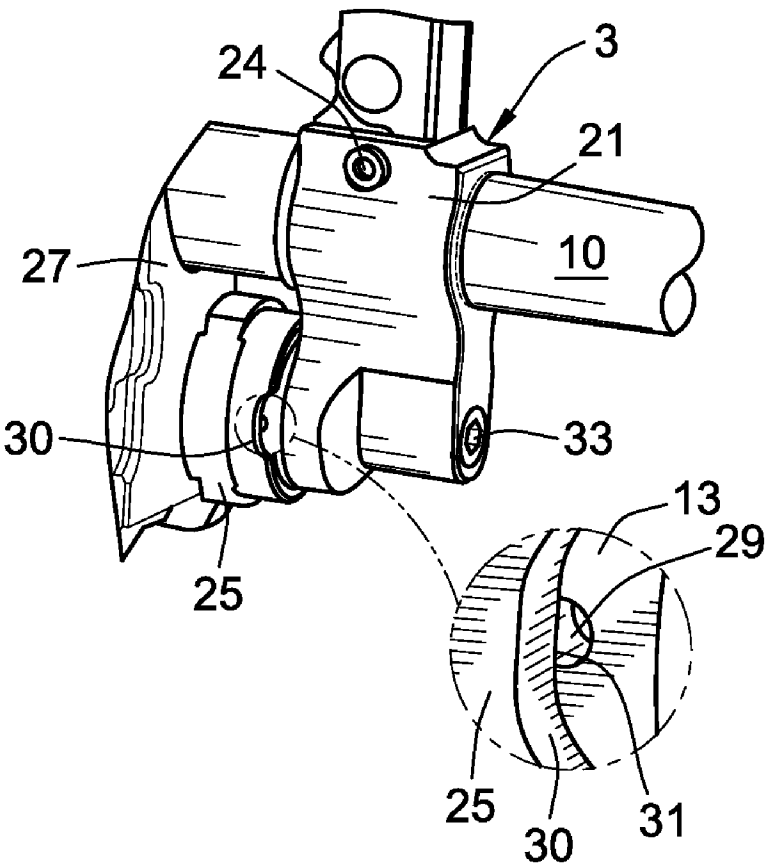
FIG. 3 depicts an enlarged view of the barrel and the example gas bleed assembly of FIG. 1 in a position representative of the barrel being relatively cold.

Turning now to FIGS. 3 and 4, the holding fixture 25 defines a recess 30 that has a front edge 31 that may at least partially cover the first gas outlet 29. The position of the recess 30 relative to the first gas outlet 29 is associated with a temperature of the barrel 10. As such, the extent to which the first gas outlet 29 is covered, varies with the barrel 10 temperature. Specifically, the recess 30 and/or at least a portion of the holding fixture 25 is a choke element that covers and/or exposes the first gas outlet 29 depending on the temperature of the barrel 10 and the temperature induced geometry change of the barrel 10.

FIG. 3 depicts the example gas bleed assembly 3 in a position representative of the barrel 10 being relatively cold. As a result, the first gas outlet 29 is partially covered by the front edge 31 and, thus, an exposed cross-sectional area of the first gas outlet 29 is relatively small. In this position, a relatively small amount of ammunition gas escapes through the first gas outlet 29 and a majority of the ammunition gas acts within the pressure chamber 14 (FIG. 1) against the gas piston 15 (FIG. 1) to move the gas piston 15 (FIG. 1) and the rod 16 (FIG. 1).

Turning back to FIG. 2, if the weapon 100 (FIG. 1) is fired for a relatively long period of time (e.g., sustained fire), the temperature of the barrel 10 increases along with the temperature of the ammunition gas. Increasing the temperature of the ammunition gas increases the gas pressure within the barrel bore 7 and, as a result, the pressure within the pressure chamber 14 also increases. As described above, increasing the pressure within the pressure chamber 14 above a predetermined level adversely increases the firing cadence and adversely subjects the components within the weapon 100 (FIG. 1) to increased mechanical stress.

In this example implementation, as the temperature of the barrel 10 increases, the barrel 10 moves (e.g., expands) relative to the housing assembly 2 (FIG. 1) in correspondence to the barrel's 10 thermal expansion coefficient. As the barrel 10 moves, the gas bleed assembly 3 and the gas cylinder 13, that are coupled to the barrel 10 via the collar 21, move along with the barrel 10. The movement of the barrel 10, the gas bleed assembly 3, the gas cylinder 13 and the first gas outlet 29 relative to the housing assembly 2 (FIG. 1), the sleeve 26, the holding fixture 25, the sealing section 28 and the recess 30 (FIG. 3) enables the first gas outlet 29 to be exposed and/or covered and changes the amount of ammunition gas that exits through the first gas outlet 29. That is, as the barrel 10 temperature increases, the barrel 10 lengthens and exposes more of the first gas outlet 29 to reduce the pressure in the pressure chamber 14.

Figure 2:
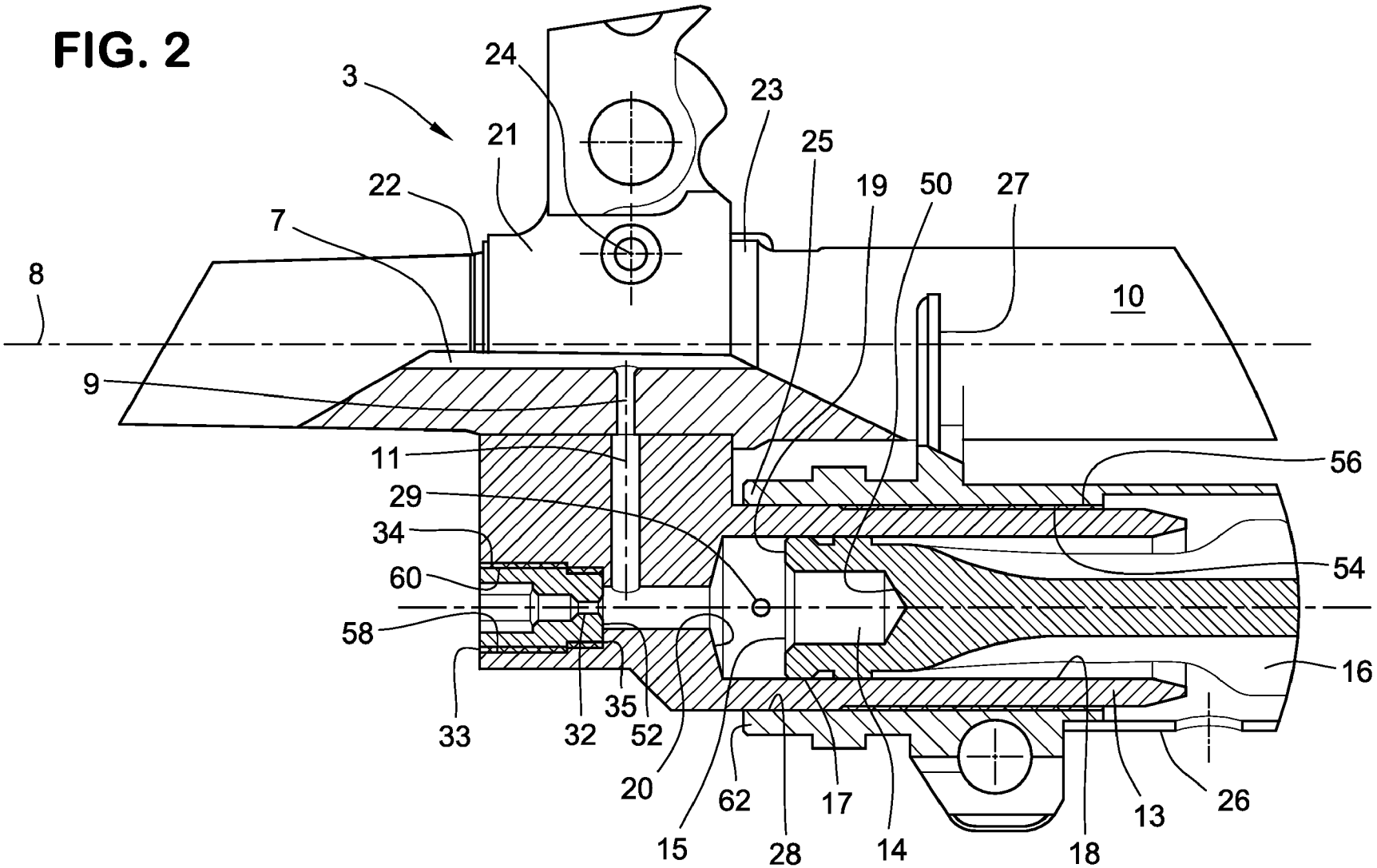
FIG. 2 depicts an enlarged view of a portion of the example barrel and the example gas bleed assembly of FIG. 1.

Turning to FIG. 4, the illustration depicts the example gas bleed assembly 3 in a position representative of the barrel 10 being relatively hot. The front edge 31 moves relative to the first gas outlet 29 in substantially an axial direction toward the rear of the firearm 100 (FIG. 1). Specifically, the first gas outlet 29 moves relative to the front edge 31 because of the heat induced barrel 10 expansion towards the front of the firearm 100 (FIG. 1). In this example implementation, the first gas outlet 29 is substantially exposed (i.e., not covered by the front edge 31) and, thus, increased ammunition gas exits the first gas outlet 29, decreasing the pressure within the pressure chamber 14 (FIG. 2). The amount that the barrel 10 expands is associated with the exposure of the first gas outlet 29 by the front edge 31. Controlling the pressure within the pressure chamber 14 (FIG. 2) substantially stabilizes the firing cadence and, thus, advantageously controls ammunition consumption and the mechanical load on the firearm 100 (FIG. 1).

If the temperature of the barrel 10 decreases, the barrel 10 contracts and the gas bleed assembly 3 and the gas cylinder 13 move to the rear of the firearm 100 (FIG. 1). As the gas bleed assembly 3 moves to the rear, the first gas outlet 29 is increasingly covered via the recess 30 and/or the front edge 31 of the holding fixture 25. At least partially covering the first gas outlet 29 when the barrel 10 is relatively cold, substantially maintains a relatively high and/or a desired firing cadence.

Turning back to FIG. 2, a second gas outlet 32 is fluidly coupled and substantially coaxial with the main channel 12. The second gas outlet 32 may provide a default setting for the firing cadence of the firearm 100 (FIG. 1) and/or a default setting of the pressure acting within the pressure chamber 14. In this example implementation, the second gas outlet 32 is defined by an insert 33 that includes external threads 58 that correspond to threads of a recess 60 of the gas bleed assembly 3.

The insert 33 is provided with a seal 34 (e.g., a sealing edge) that creates a seal between the insert 33 and the gas bleed assembly 3. Additionally, the insert 33 engages a seat 35 defined by the gas bleed assembly 3. The relationship between the insert 33 and the seal 34 and the seat 35 substantially prevents ammunition gases from exiting between the insert 33 and the gas bleed assembly 3. The face 52 of the gas cylinder 13 is adjacent the seal 34 and the second gas outlet 32. The pressure chamber 14 includes the faces 20 and 52.

To change the default setting of the gas bleed assembly 3, different inserts 33 with different second gas outlets 32 may be threaded into the recess 60. Some example inserts 33 define a second gas outlet 32 that is relatively large such that when the front edge 31 (FIG. 3) partially covers the first gas outlet 29, a base cadence is set to approximately 800 rounds per minute with a tolerance of roughly +/−50 to +/−100 rounds per minute. The insert 33 enables the gas bleed assembly 3 to be adapted to different housing assemblies 2 (FIG. 1) on different types and/or styles of firearms 100 (FIG. 1). Additionally, production, manufacturing and assembly tolerances can be compensated for by selecting an appropriate insert 33 with a corresponding second gas outlet 32. Specifically, if the recess 30 (FIGS. 3 and 4) and/or the front edge 31 (FIGS. 3 and 4) covers the first gas outlet 29 too much or too little, the insert 33 can be selected to substantially achieve a desired firing cadence during different barrel temperatures (e.g., a relatively high barrel 10 temperature and/or a relatively low barrel 10 temperature) and/or to offset the manufacturing tolerances and/or defects.

In the example implementation, the pressure chamber 14 is defined by the gas cylinder 13 that is positioned adjacent the holding fixture 25. In other example implementations, the pressure chamber 14 may be positioned in any other suitable position such as, for example, the pressure chamber 14 may be defined by the gas cylinder 13 and coupled to the sleeve 26 via a second holding fixture (not shown).

The gas piston 15 moves relative to the holding fixture 25. Additionally, the amount that the front edge 31 (FIGS. 3 and 4) of the holding fixture 25 covers and/or exposes the first gas outlet 29 inside the gas cylinder 13 is associated with the heat induced expansion of the barrel 10.

The first gas outlet 10 is depicted having a substantially round cross-section. However, the first gas outlet 10 may be implemented having any suitable shape and/or size such as, for example, a rectangular cross-section, or a triangular cross section, etc. Different size and/or shape cross-sections may facilitate a substantially linear relationship between the amount the recess 30 and/or the front edge 31 (FIGS. 3 and 4) covers the first gas outlet 29 and the flow of ammunition gas through the first gas outlet 29. In other examples, the gas bleed assembly 3 may be provided with any number of first gas outlets 29 (e.g., 2, 3, 4, 5) that may be arranged in any suitable arrangement such as, for example, the first gas outlets 29 may be axially offset such that the different first gas outlets 29 are exposed and/or covered in succession.

In other examples, the insert 33 may be provided with an adjustable valve (not shown) that enables the size and/or flow through the second gas outlet 32 to be adjusted to correspond to the desired base cadence and/or to the firearms 100 configuration.

Figure 5:
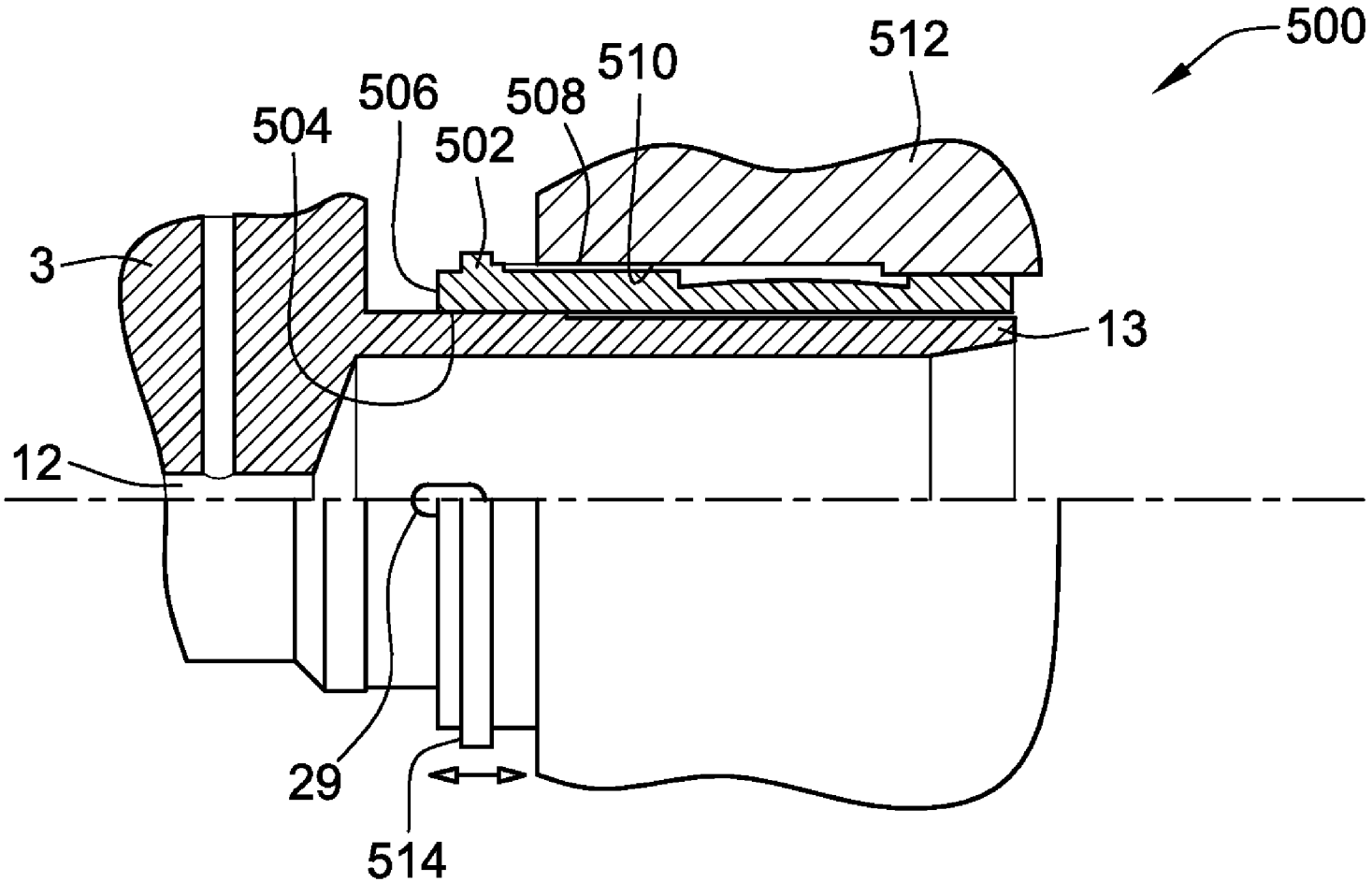
FIG. 5 depicts an enlarged view of a portion of the example barrel and an alternative example gas bleed assembly.
Figure 6:
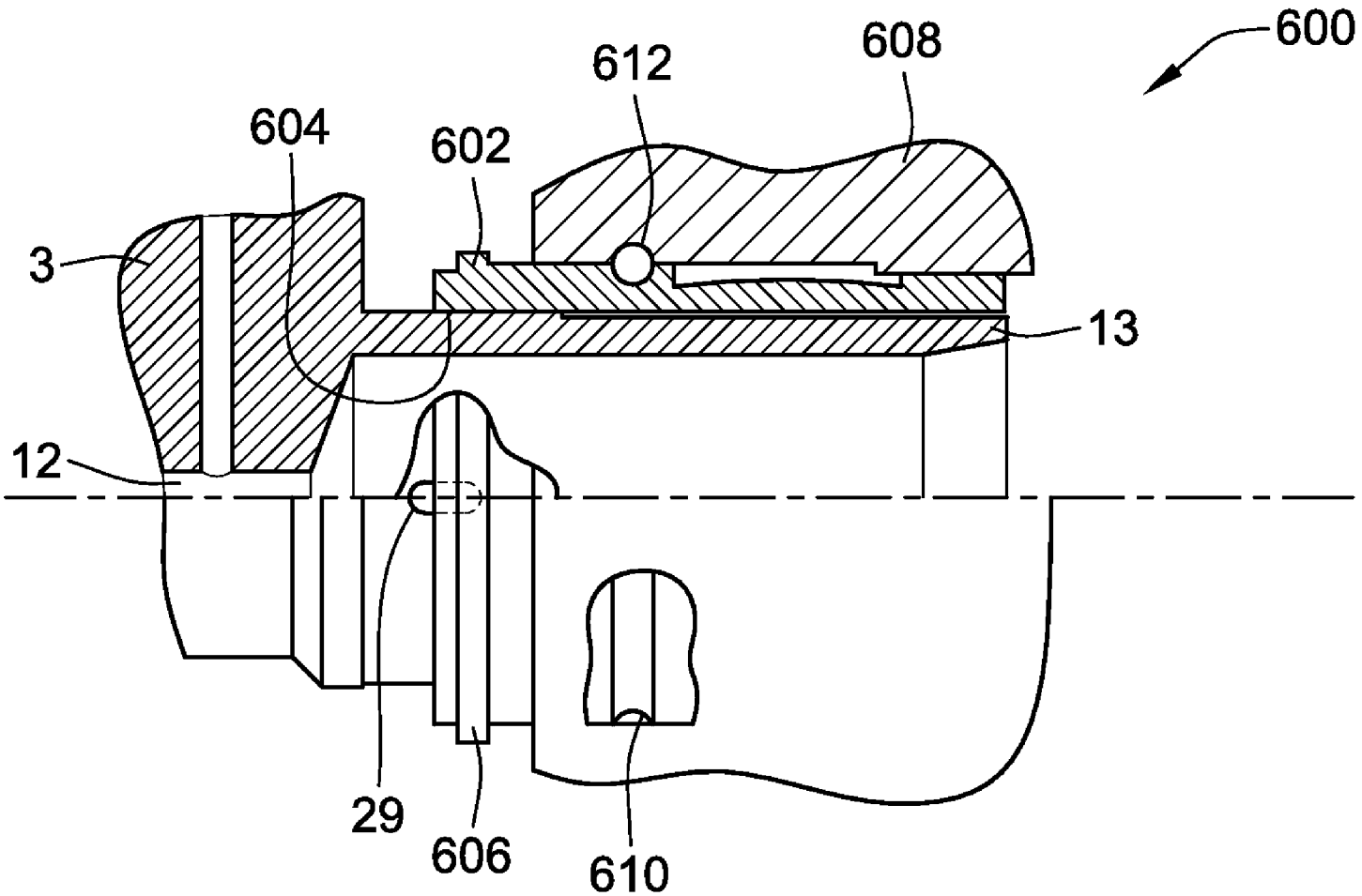
FIG. 6 depicts an enlarged view of a portion of the example barrel and another alternative example gas bleed assembly.

FIGS. 5 and 6 depict the relationship between the gas bleed assembly 3, alternative example holding fixtures 502 and 602, alternative example sealing sections 504 and 604, alternative example front edges 506 and 606, housing units 512 and 608 and the first gas outlet 29. Example firearms 500 and 600 enable the firing speed to be adjusted and/or a default setting to be selected and may be utilized in combination with or in place of the insert 33 (FIG. 2). If the example firearms 500 and 600 do not include the insert 33, the first gas outlet 29 may be adjusted by rotating and/or turning the holding fixtures 502 and 602. In some example implementations, the main channel 12 and/or the second gas outlet 32 may have a standard size. Specifically, the holding fixtures 502 and 602 are axially adjustable to change the exposure of the first gas outlet 29 (e.g., the exposure of the first gas outlet 29 prior to firing the firearms 500 and 600 and/or when the barrel 10 is relatively cool).

The illustrated example of FIG. 5 includes the holding fixture 502 that includes an external threaded surface 508 that corresponds to threads 510 of the housing unit 512. Rotating and/or turning the holding fixture 502 moves the holding fixture 502 relative to the sleeve 26 (FIGS. 1 and 2). The gas bleed assembly 3 is positioned within the holding fixture 502 and includes the sealing section 504 and the front edge 506 that at least partially covers the first gas outlet 29. Rotating or otherwise moving the holding fixture 502 axially moves the holding fixture 502 relative to the housing unit 512 and, thus, changes the size of the first gas outlet 29 that is exposed. As discussed above, changing the amount that the first gas outlet 29 is exposed changes the default setting, the firing speed and/or firing cadence of the firearm 500. In some example implementations, the example firearm 500 may be provided with a lock nut (not shown) that is positioned between the housing unit 512 and a shoulder 514 to substantially prevent unwanted adjustments of the holding fixture 502 relative to the housing unit 512. Alternatively, the example firearm 500 may be provided with any other suitable means to prevent accidental adjustments of the holding fixture 502.

The illustrated example of FIG. 6 includes the holding fixture 602 that is axially fixed relative to the housing unit 608. Specifically, the holding fixture 602 defines a circular groove 610 that corresponds to a safety device 612 (e.g., a ring pin) that enables the holding fixture 602 to move (e.g., twist and/or rotate) relative to the housing unit 608 while being axially fixed. The gas bleed assembly 3 is positioned within the holding fixture 602 and includes the sealing section 604 and the front edge 606 that at least partially cover the first gas outlet 29. In this example implementation, the front edge 606 is slightly inclined and/or curved such that different portions of the front edge 606 may be closer or farther away from the flash suppressor 6 (FIG. 1). Specifically, as the holding fixture 602 is rotated, the amount that the front edge 606 covers the first gas outlet 29 depends on the portion of the front edge 606 that covers the first gas outlet 29. As discussed above, changing the amount that the first gas outlet 29 is exposed changes the default setting, the firing speed and/or firing cadence of the firearm 600. In some example implementations, the example firearm 600 may be provided with any suitable means to prevent the accidental adjustment and/or turning of the holding fixture 602 such as, for example, the example firearm 600 may be provided with a safety clamp (not shown).

In the foregoing examples, the barrel 10, the first gas outlet 29, the holding fixtures 25, 502 and 602, the sealing sections 28, 504 and 604, the recess 30, and the front edges 31, 506 and 606 are arranged such that the expansion and/or contraction of the barrel 10 due to temperature change enables movement of the gas cylinder 13 relative to the holding fixtures 25, 502 and 602, the sealing sections 28, 504, 604, the recess 30, and the front edges 31, 506 and 606. As a result, the gas pressure acting within the pressure chamber 14 corresponding to the temperature of the barrel 10 is substantially stabilized. In practice, as the temperature of the barrel 10 increases, the pressure and flow ratios within the gas cylinder 13 also change such that the increase in gas pressure within the barrel 10 does not substantially increase the pressure within the pressure chamber 14. Specifically, as discussed above, as a length of the barrel 10 increases and/or decreases, the cross-section of the first gas outlet 29 is covered and/or exposed by the recess 30 and/or the front edges 31, 506 and 606. As the temperature of the barrel 10 decreases, the barrel 10 length also retracts and the holding fixtures 25, 502 and 602, the sealing sections 28, 504, 604, the recess 30, and the front edges 31, 506 and 606 incrementally cover the first gas outlet 29 as the gas bleed assembly 3 and the gas cylinder 13 retract along with the barrel 10. As a result, the relatively low gas pressure within the barrel 10 does not substantially change the gas pressure within the pressure chamber 14 and the desired firing cadence is substantially maintained.

The holding fixtures 25, 502 and 602, the sealing sections 28, 504 and 604, the recess 30, and/or the front edges 31, 506 and 606 may be arranged in any suitable position relative to the gas cylinder 13 such as, for example, within the gas cylinder 13 or outside the gas cylinder 13.

The holding fixtures 25, 502 and 602 are at least partially coupled to the housing assembly 2 and, thus, the position of the holding fixtures 25, 502 and 602, the sealing sections 28, 504 and 604, the recess 30, and/or the front edges 31, 506 and 606 are relatively consistent. As discussed above, the axial movement of the barrel 10 is associated with controlling the exposure of the first gas outlet 29. The holding fixtures 25, 502 and 602 and the gas cylinder 10 are substantially coaxial. Additionally, the holding fixtures 25, 502 and 602 may at least partially surround the gas cylinder 10.

As described above, the holding fixtures 25, 502 and 602, the sealing sections 28, 504, 604, the recess 30, and/or the front edges 31, 506 and 606 are positioned such that a temperature change in the barrel 10 changes the position of the first gas outlet 29 relative to the front edges 31, 506 and 606. Additionally, in this example implementation, the first gas outlet 29 is positioned radially relative to the gas cylinder 13.

The sealing sections 28, 504, 604 create a seal between the holding fixtures 25, 502 and 602 and the gas cylinder 13 and the first gas outlet 29 and, thus, the sealing sections 28, 504, 604 may at least partially cover the first gas outlet 29 depending on the position of the gas cylinder 13 relative to the holding fixtures 25, 502 and 602. Specifically, as the first gas outlet 29 moves relative to the sealing sections 28, 504 and 604, the first gas outlet 29 is covered and/or exposed as the pressure within the barrel changes (e.g., increases and/or decreases) and, thus, the pressure within the pressure chamber 14 is substantially constant. Additionally, in some example implementations, the holding fixtures 502 and 602 may position the sealing sections 504 and 604 and the front edges 506 and 606 such that the front edges 506 and 606 cover a portion of the first gas outlet 29 such as, for example, a lower portion of the first gas outlet 29. Additionally, the holding fixtures 502 and 602 may be adjustable to change, for example, the axial position of the sealing sections 504 and 604 and the front edges 506 and 606 relative to the first gas outlet 29.

The gas cylinder 13 is coupled to the barrel 10 via the collar 21, and the gas cylinder 13 is fluidly coupled to the barrel bore 7 via the gas duct 11, the main channel 12 and the tapping section 9. In this example implementation, the collar 21 is made of a single piece of material. However, the collar 21 may be made of any number of pieces of material (2, 3, 4, 5, etc.). Coupling the gas cylinder 13 to the barrel 10 via the collar 21 enables the gas cylinder 13 and the gas bleed assembly 3 to move substantially axially along with the barrel 10 and to enable covering and/or exposing the first gas outlet 29.

In one example, the collar 21 is coupled to the barrel 10 by the pinning 24. However, the collar 21 may be coupled to the barrel 10 by any other suitable means. The engagement between the collar 21 and the barrel 10 creates a seal such that no ammunition gas exiting between the collar 21 and the barrel 10. The pinning 24 couples the collar 21 and the gas cylinder 13 circumferentially relative to the barrel 10.

Additionally, the holding fixtures 25, 502 and 602 are coupled to the housing assembly 2 via the sleeve 26 that substantially surrounds the rod 16. The sleeve 26 substantially protects the rod 16 from, for example, the elements (e.g., snow, dirt, etc.) and at least partially shields the sleeve 26 from the temperature of the barrel 10.

In some example implementations, the supporting element 27 substantially prevents a shearing force, that acts on the holding fixtures 25, 502 and 602 from being transferred to the gas cylinder 13 and from hindering the relationship and/or movement between the holding fixtures 25, 502 and 602 and the gas cylinder 13 and the gas bleed assembly 3.

The gas cylinder 13 may be fluidly coupled the insert 33 that defines the second gas outlet 32. The second gas outlet 32 may be associated with the firearm 100 firing cadence. As discussed above, the second gas outlet 32 may be any shape and/or size and the insert 33 may threadingly engage the recess 60. Additionally, the insert 33 may be provided with an adjustable control valve to vary the flow through the second gas outlet 32. The gas bleed assembly 3 and the methods and apparatus described herein may be used in conjunction with any suitable weapon and/or barrel such as, for example, a machine gun.

Furthermore, although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. Gas bleed assembly for use with a firearm having a barrel, comprising:

a gas cylinder that defines at least one gas outlet to be fluidly coupled to a bore of a barrel, wherein the gas cylinder is substantially fixed relative to the barrel;

a holding fixture that is substantially fixed relative to a housing having a front edge, wherein the holding fixture interacts with the at least one gas outlet; and wherein a temperature induced variation of geometry of the barrel changes a position of the gas cylinder relative to the holding fixture and wherein a pressure acting within the gas cylinder is associated with the position of the at least one gas outlet relative to the holding fixture.

2. The gas bleed assembly as defined in claim 1, wherein the holding fixture is adjacent the gas cylinder.

3. The gas bleed assembly as defined in claim 1, wherein the holding fixture at least partially surrounds the gas cylinder and wherein the gas cylinder is axially displaceable relative to the holding fixture.

4. The gas bleed assembly as defined in claim 3, wherein the holding fixture further comprises a sealing section that is positioned at least partially between the holding fixture and the gas cylinder and wherein the position of the sealing section relative to the gas cylinder is associated with the temperature of the barrel.

5. The gas bleed assembly as defined in claim 1, wherein the position of the gas cylinder relative to the holding fixture changes an exposure of the at least one gas outlet.

6. The gas bleed assembly as defined in claim 1, wherein the gas cylinder radially defines the at least one gas outlet.

7. The gas bleed assembly as defined in claim 1, wherein at least a portion of the holding fixture is axially adjustable relative to the at least one gas outlet.

8. The gas bleed assembly as defined in claim 7, wherein the at least the portion of the holding fixture substantially seals the at least one gas outlet.

9. The gas bleed assembly as defined in claim 7, wherein adjusting the portion of the holding fixture relative to the at least one gas outlet changes a position of the portion of the holding fixture relative to the at least one gas outlet.

10. The gas bleed assembly as defined in claim 1, wherein the gas cylinder is to be coupled to the barrel via a collar and wherein the collar at least partially surrounds the gas chamber.

11. The gas bleed assembly as defined in claim 10, wherein the gas cylinder is to be fluidly coupled to the bore of the barrel via one or more passages at least partially defined by the gas cylinder.

12. The gas bleed assembly as defined in claim 10, wherein the collar comprises a single piece of material.

13. The gas bleed assembly as defined in claim 10, wherein the collar is press fit relative to the barrel and wherein the collar includes a pinning to couple the collar to the barrel.

14. The gas bleed assembly as defined in claim 1, wherein the holding fixture is coupled to a sleeve of a housing assembly.

15. The gas bleed assembly as defined in claim 14, wherein the sleeve at least partially surrounds a rod.

16. The gas bleed assembly as defined in claim 1, wherein the holding fixture is at least partially supported via a supporting element.

17. The gas bleed assembly as defined in claim 16, wherein the supporting element is to be positioned at substantially a right angle relative to the barrel.

18. The gas bleed assembly as defined in claim 1, wherein the gas cylinder defines a second gas outlet that is associated with a firing cadence of the firearm.

19. The gas bleed assembly as defined in claim 18, wherein the gas cylinder comprises a removable insert that defines the second gas outlet.

20. The gas bleed assembly as defined in claim 18, wherein the second gas outlet is adjustable via a control valve.

21. The gas bleed assembly as defined in claim 1, wherein the gas bleed assembly is integrally coupled to the barrel of the firearm.

* * * * *